US010577543B2

(12) United States Patent
Wallage

(10) Patent No.: US 10,577,543 B2
(45) Date of Patent: Mar. 3, 2020

(54) EFFICIENT OIL SHALE RECOVERY METHOD

(76) Inventor: Raymond Roger Wallage, Scottsdale, AZ (US)

( * ) Notice: Subject to any disclaimer, the term of this patent is extended or adjusted under 35 U.S.C. 154(b) by 0 days.

(21) Appl. No.: 13/338,883

(22) Filed: Dec. 28, 2011

(65) Prior Publication Data

US 2012/0100588 A1 Apr. 26, 2012

Related U.S. Application Data

(60) Provisional application No. 61/552,115, filed on Oct. 27, 2011.

(51) Int. Cl.
*C10G 32/00* (2006.01)
*C10G 1/00* (2006.01)

(52) U.S. Cl.
CPC ..... *C10G 32/00* (2013.01); *C10G 1/00* (2013.01)

(58) Field of Classification Search
None
See application file for complete search history.

(56) References Cited

U.S. PATENT DOCUMENTS 2,641,565 A 6/1953 Sanderson
2,641,566 A * 6/1953 Zobell ..... C09K 8/905 435/281
2,907,389 A * 10/1959 Hitzman ..... 299/17
3,000,793 A * 9/1961 McDaniel ..... 435/86
3,326,773 A * 6/1967 Kakinuma Nishinomiya Atsushi et al. ..... 435/110
3,340,930 A * 9/1967 Hitzman ..... 166/246
3,711,392 A * 1/1973 Metzger ..... A23C 20/02 204/514
3,982,995 A 9/1976 Yen
3,992,146 A * 11/1976 Fazzalari ..... C11D 3/48 422/29
4,003,821 A * 1/1977 Weil ..... C10G 1/002 208/400
4,043,885 A * 8/1977 Yen ..... C25B 3/00 205/696
4,169,802 A * 10/1979 Basile ..... C01G 37/02 252/62.51 C
4,584,088 A * 4/1986 McCollum et al. ..... 208/430
4,846,964 A * 7/1989 Scott et al. ..... 208/428
5,049,499 A * 9/1991 Atlas et al. ..... 435/170
5,290,691 A * 3/1994 Mitsuhashi et al. ..... 435/252.31
5,476,775 A * 12/1995 Fodge et al. ..... 435/209
6,294,351 B1 * 9/2001 Lin ..... C09K 8/58 435/244
6,852,835 B2 * 2/2005 Collmer et al. ..... 530/350
6,942,998 B1 * 9/2005 Ooteghem ..... 435/168
8,158,396 B2 * 4/2012 Maclennan ..... C12N 1/18 435/161
2002/0079266 A1 6/2002 Ainsworth
2003/0080029 A1 * 5/2003 Zwick ..... C10G 1/04 208/435
2005/0271770 A1 * 12/2005 Hughes ..... 426/49
2008/0107784 A1 * 5/2008 Lankhorst et al. ..... 426/271
2009/0017513 A1 * 1/2009 Bell ..... C12P 5/00 435/166
2009/0050532 A1 * 2/2009 Chirico ..... 208/177
2009/0104349 A1 * 4/2009 Hills et al. ..... 427/242
2009/0155703 A1 * 6/2009 Sacripante et al. ..... 430/108.1
2010/0047793 A1 * 2/2010 Toledo ..... C09K 8/582 435/6.12
2010/0105115 A1 * 4/2010 Simpson et al. ..... 435/135
2010/0105975 A1 * 4/2010 Baird ..... E21B 41/0057 588/16
2010/0163460 A1 * 7/2010 Szuhay ..... C10G 1/00 208/419
2010/0203495 A1 8/2010 Medoff
2010/0261895 A1 10/2010 Noll
2012/0003623 A1 * 1/2012 Bartee ..... G05B 17/02 435/3
2012/0149076 A1 6/2012 Granda

FOREIGN PATENT DOCUMENTS

WO WO 98/22195 A1 * 5/1998

OTHER PUBLICATIONS

Vrvic et al. Organic Geochemistry (1990) 16(4-6): 1203-1209.*
Definition of fermentation from www.thefreedictionary.com/fermentation, downloaded Nov. 18, 2012.*
Definition of slurry from www.thefreedictionary.com/slurry, downloaded Nov. 18, 2012.*
Cuypers et al. Soil and Sediment Contamination (2001) 10(5): 459-482.*
Goklen et al. Ind. Eng. Chem. Prod. Res. Dev. (1984) 23: 308-311.*
Zhao et al.J. Hazardous Material B73 (2000) 77-85.*
Defintion of "scissors" downloaded from www.thefreedictionary.com/scissors on Jul. 11, 2015.*
Smoot et al.(Proc. Florida State Horticultural Soc (1971; vol. date: 1970) 83: 225-228.*
Parish et al. J. Food Protection (1989)52(4): 261-263.*
Nishida et al. J. Bacteriology (1966) 91(2): 477-483.*
Takeda Soil Sci. Plant Nutrition (1975) 2192): 113-118.*
Kampfer et al. Microb. Ecol. (1991) 21: 227-251.*
Defintion of ambient from http://www.dictionary.com/browse/ambient downloaded Sep. 22, 2016.*
Tournas et al. Int. J. Food Microbiol. (2005) 105: 11-17.*
Bird et al. Chem Society Reviews (1974) 3(3): 309-328.*
Defintion of aqueous downloaded from the freedictionary.com webstie at http://thefreedectionary.com/aqueous on Oct. 24, 2016.*
Chemistry, 7th Edition, Houghton Mifflin Company, Boston (2007) p. 663.
"Aqueous Solution", Wikipedia (found at https://en. wikipedia.org/wiki/Aqueous_solution).
"Oil Shale", (found at https://en.wikipedia.org/wiki/Oil_shale).
Reference .com found at https://www.reference.com/food/kind-mold-grows-oranges-f560ddd20172c8d3.

* cited by examiner

*Primary Examiner* — Susan M Hanley
(74) *Attorney, Agent, or Firm* — Arno Naeckel

(57) ABSTRACT

A method for recovering hydrocarbons from oil shale and other carbonaceous materials has the steps of preparing a biomedium of microorganisms, water, and nutrients; providing shale laden with oil; treating oil shale with the biomedium; mechanically agitating the treated oil shale and biomedium approximately twelve hours to form a liquid suspension; and separating the components of the liquid suspension to yield a hydrocarbon mixture.

7 Claims, No Drawings

EFFICIENT OIL SHALE RECOVERY METHOD

RELATED APPLICATION

This application claims the benefit of U.S. Provisional Application No. 61/552,115, filed on Oct. 27, 2011.

TECHNICAL FIELD

The inventive process is in the field of obtaining hydrocarbons from oil shale, and more specifically a process conducted at room temperature with the use of microorganisms.

BACKGROUND

Huge quantities of hydrocarbons are trapped in geologic formations around the world. Crude oil and natural gas are the only liquid hydrocarbons that naturally occur; they are viewed as strategic resources because of technological dependency on petroleum products including fuel and raw materials. Coal is a significant source of hydrocarbons for energy production and manufacturing.

Crude oil, natural gas, and coal are the most widely utilized sources of hydrocarbons because they are relatively inexpensive to find and refine. However, every spike in the price of common hydrocarbons stimulates interest in alternative sources of hydrocarbons.

Oil shale is such an alternative source. Oil shale is a petroleum source rock composed of inorganic sedimentary particles and appreciable organic material. Kerogen, the organic material in oil shale, is the solid precursor to crude oil, natural gas, and coal. Over geologic time, kerogen deep in the Earth decomposes under geothermal pressure and transforms into petroleum products. Some estimates suggest that global deposits of oil shale contain roughly three trillion barrels of recoverable hydrocarbons.

This geologic process can be mimicked by retorting. This method of extracting recoverable hydrocarbons involves heating oil shale to several hundred degrees centigrade in the absence of oxygen. The kerogen in the oil shale decomposes into numerous hydrocarbon-rich gases which are collected and liquefied. The liquefied "shale oil" is refined and processed similarly to crude oil.

Unfortunately, many oil shale deposits contain as little as 25% kerogen. There is a significant energy loss associated with heating the inert geologic materials in the oil shale to several hundred degrees centigrade. Thus, shale oil is not economically viable as to "energy return on energy invested" (EROEI), unless the price of crude oil is greater than about $75 a barrel. Retorting on a large scale is not desirable because of environment pollution and excessive demand upon water resources. The environmental pollution is exacerbated because potentially valuable inorganic materials and metals are not recovered from the spent shale.

The EROEI can be improved by enriching the kerogen content prior to retorting. This enrichment is very problematic because kerogen is insoluble and impervious to organic solids. One solution is to crush the oil shale in order to expose more kerogen during retorting. Other solutions include using acid treatments to reduce the amount of rock in a sample of shale.

Biotic decomposition of kerogen has been unsuccessful. There are known species of bacteria that are able to consume kerogen, but the bacteria excrete unknown compounds. On the other hand, while bacteria have been genetically-modified bacteria to excrete hydrocarbons, these do not consume kerogen.

Although producing hydrocarbons through biotic decomposition has not proven successful, there has been limited success in processing oil shale with microorganisms. For instance, the ability of certain bacteria to excrete acid has been applied to dissolve the inorganic sedimentary matrix in oil shale. (See U.S. Pat. No. 3,982,995). That inventive method produces sponge-like shale with increased surface area to promote combustion of the kerogen within. Similarly, an early inventive method used microorganisms to free kerogen in finely-ground powders of shale (See U.S. Pat. No. 2,641,565).

Coal, which is a solid derivative of kerogen, can be processed similarly to oil shale in order to obtain liquid and gaseous hydrocarbons. All methods of coal liquefaction and gasification require significant heating of the coal. This leads to the same problems as with shale oil including low EROEI and extensive environmental pollution.

Cellulose does not contain hydrocarbons. However, microorganisms such as yeast can convert cellulose and water into liquid hydrocarbons through a process called fermentation. Agricultural waste and recycled wood are common sources of cellulose for such purposes. As with methods of hydrocarbon recovery, manufacture of hydrocarbons from cellulose has significant drawbacks including low EROEI and extensive environmental pollution.

SUMMARY OF INVENTION

In one embodiment, there is disclosed a method for recovering hydrocarbons from oil shale. The method includes the steps of providing a biomedium of microorganisms, water, and nutrients; providing shale laden with oil; treating the oil shale with the biomedium; mechanically agitating the treated oil shale and biomedium approximately twelve hours to form a liquid suspension; and separating the components of the liquid suspension to provide a hydrocarbon mixture. Optionally, the nutrients can include sugar and molasses. Optionally, the biomedium further includes muriatic acid and yeast. The mechanical agitation can be rotary tumbling. The step of separating of enriched kerogen from remaining components of the liquid suspension is optionally performed by centrifugation.

In another embodiment, there is disclosed a method of producing a liquid hydrocarbon compounds from at least one carbonaceous compound. The method has the steps of providing a biomedium of microorganisms, water, and nutrients; providing at least one carbonaceous compound; treating the carbonaceous compound with the biomedium to produce a liquid suspension; and separating the components of the liquid suspension to provide a liquid hydrocarbon mixture.

DETAILED DESCRIPTION AND EXEMPLARY EMBODIMENTS

This invention presents a method for recovering hydrocarbons from oil shale using microorganisms in a biomedium. This is advantageous over prior methods like retorting because waste and pollution are reduced. I have found that there is no need to heat the oil shale, thereby making the inventive method less expensive than other methods of shale oil extraction. This method is also adaptable to recover hydrocarbons from coal and cellulose materials.

Oil shale, coal, or cellulose is treated with a biomedium containing microorganisms, water, and nutrients and mechanically agitated. During the process, the microorganisms recover hydrocarbons from the oil shale, coal, or cellulose. After a suitable period of mechanical agitation, a liquid suspension of biomedium, hydrocarbons, and inert materials is produced. The components of the liquid suspension are optionally further purified by filtration, cleaning, and washing.

The EROEI of this method is significantly higher than previous methods for hydrocarbon recovery. The biomedium can be recycled and used again. Furthermore, the inert materials are fine particles in the liquid suspension; potentially valuable metals, minerals, elements, and compounds are more easily extracted from such particulates and have not been obtained from other processes.

This method is environmentally friendly for three reasons. First, it avoids the unnecessary energy expenditures associated with heating inert materials. Second, it uses naturally occurring non-human microorganisms rather than harsh acid or base. Third, the biomedium can be recycled and reused. Lab tests suggest the components of the gases released are "nitrogen, oxygen, argon, carbon dioxide, neon, methane, and helium in amounts that are substantially similar to the composition of air. The inert materials from which no valuable metals, minerals, elements, or compounds can be extracted are returned to the mining site to rehabilitate the land.

Microorganisms are used to recover hydrocarbons in oil shale and coal; the microorganisms potentially can produce hydrocarbons from any cellulose material. In one embodiment, the microorganisms are taught or induced to recover hydrocarbons by lightly sealing microorganisms, water, and nutrients with a source of hydrocarbons such as oil shale or coal After about twenty one days or less, a biomedium containing microorganism develops that recovers the hydrocarbons trapped in the oil shale or coal.

The laboratory tests by the applicant have shown just about any microorganism found on or around plants can be used with varying degrees of success. Once we selected the microorganism(s), we blended these microorganisms to "marry" them. In the lab, we used a typical blender. In a commercial scale operation larger industrial blenders are used. There is often sufficient water in the medium for the process to take place, but we optionally add a small amount of water to help liquefy the cultures.

To the newly liquefied cultures, we add a food or other accelerant source, such as sugar, molasses, yeast and a quick release aqueous, nontoxic, environmentally safe surfactant; and blend the mix again.

Sugars. We have tried using different kinds of sugar, all the white sugars, including bakers special sugar, barbados sugar, confectioners' sugar, powdered sugar, coarse sugar, date sugar, fruit sugar, granulated sugar, raw sugar, sanding sugar, superfine, ultra fine (or bar sugar), and even sugar cubes (made from moist granulated sugar), brown sugars, including light and dark brown sugar, demerara sugar, muscovado sugar, free flowing brown sugars, turbinado sugar, and even some of the liquid sugars such as liquid sugar and invert sugar to varying degrees of success, and we even tried some locally purchased sugars that were not identified as anything other than sugar with a brand name, but the best results came from natural granulated pure cane sugar.

Molasses. Here again we have tried a variety of molasses, from fancy molasses, lite molasses, cooking molasses, unsulphured molasses, and blackstrap molasses. As with the sugars, sometime the type of molasses is not easily identifiable on the package. Nevertheless, we have tried all we could find. The best results have been obtained with the blackstrap molasses.

Yeast. With yeast the selection of which to use may be scientifically harder, since there are at least 1,500 species currently identified. To obtain our yeast, we shopped various grocery stores and tried every kind they sold, with the best results being those that were labeled simply "active dry yeast."

The next step varies depending on what is to be liquefied, oil shale, coal, or cellulose material. The process however is the basically same except for material. At this point, I will describe the ratios established for a small blend. We then added about three cups of oil shale, coal, or cellulose material (whatever we wished to liquefy) to a glass container, stirred, added about 1.5 teaspoons (0.5 fluid ounces) of muriatic acid, and stirred or whisked. The acid is the same strength as found for swimming pool use, which we considered relatively safe. We have tried both with and without the addition of muriatic acid. While the result is the same, the entire blend seems to react better and work faster when the acid is added. We have found the same results in plastic and steel containers. We have changed the order of the steps with successful results; however, the preceding description of steps gave the most aggressive results. We tested omitting one or more constituents; these methods however, met with decreasing success.

After thorough mixing, the next step was sealing the container (not too tight as the action of the microorganisms will generate a positive pressure from a small amount of gas production). If the lid is too tight, one risks the container or lid breaking and losing the microorganism blend.

Next, we stored the mix of microorganism(s) and oil shale (coal or cellulose) in a dark place for at least 30 minutes before checking progress. Signs of progress are small bubbles forming throughout the mix, which means that the mixture is working. This is a positive sign, but it is not necessarily bad if there are no bubbles, which may take longer to form. Then we placed the container back in a dark place where the temperature is between 50° F. (10° C.) and no higher than 100° F. (37.8° C.). It is likely that the microorganisms that grew at room temperature will be successful there.

A preferred storage time was as much as 21 days before use, but less time also worked. Basically the longer is the incubation time (up to the 21 days), the greater is the yield from the blend. During this period, the microorganisms may be adapting to use portions of the feedstock, the oil shale, coal, or cellulose material and causing the feedstock to liquefy. We call this the "training time" or "incubation time." Within the 21-day period, the mixture has continued to show small bubbles forming in the mixture.

I have not tested incubation times in excess of the 21 days; but I have stored the microorganism mix longer, as much as 6 months to a year (in one case well over a year), and the microorganisms simply seemed to go dormant, and no more bubbles were created.

I have tested larger quantities of microorganisms. The above microorganism mixture was about 8 cups (64 fluid ounces) in volume. We planned to grow the microorganism mixture by 400%. We began with four one gallon jars, and placed 2 cups (16 fluid ounces) of the original microorganism mix into each jar. The amounts need not be exact.

I then took 1 cup (8 ounces) of warm water along with four medium-size moldy oranges and blended it until it was a homogeneous fluid. The volume of this was about 4 cups (32 fluid ounces). We then divided this new microorganism mix equally into four gallon jars.

I then added 3 cups (24 fluid ounces) of warm water to each jar. We next added 1 tablespoon (0.5 fluid ounce) of molasses, 0.5 teaspoon (0.083 fluid ounce) of sugar (sprinkled on top of the mixture), and 1 teaspoon (0.17 fluid ounces) of yeast sprinkled on top. We stirred or whisked this mixture until the accelerants were blended.

I then added 1 teaspoon (0.17 fluid ounce) of muriatic acid into 0.5 cup of warm water and added it to each jar where it had the same strength as found in swimming pools; and again stirred or whisk until blended.

The addition of the ingredients in the order above is the currently preferred method; however, we tested varying the order, and while the end results are the same, the order above seems to give the most effective result. We even tested leaving one or more of the ingredients out, and varying the quantity of the ingredient with varying results.

Although it may not be necessary, we most often added ⅓ cup (2.67 fluid ounces) of new oil shale, coal, or cellulose material (whatever we wished to liquefy). However, we believe this addition may be unnecessary.

This mixture expanded the original volume of microorganism mix to about 96 ounces of biomedium in each jar. We believe that one can grow it to larger volumes simply by scaling the proportions to fit the volume.

Then we sealed each jar and stored them in a dark area where the temperatures are comfortable for humans. The required number of days of storage here seemed to be much shorter, roughly 3-4 days. It could be stored longer with no decrease in effectiveness.

The 96-ounce microorganism mixture is about the smallest amount needed for commercial liquefaction of oil shale, coal or cellulose material and that is the next step.

I expect even larger quantities will be needed for some commercial processes. To start, I plan to use a tumbler or concrete mixer to rotate and/or agitate the mix without spilling. For example, smaller scale commercial rock tumblers usually are built to optionally seal the tumbler watertight, but concrete mixers do not. If the container is not sealed, there may be off gassing of methane, but the amount is small. Optionally, tumbling medium is placed into the rotary tumbler to reduce the oil shale rock size faster. Tumbling medium includes ceramic figures, metal shot, abrasive particles, as well as any other medium normally used by a person of ordinary skill in the art.

22-Gallon Batch Directions. I used a small tumbler capable of holding about 22 pounds (about 10 kilograms) of oil shale, coal or cellulose material. I used a tumbler with a capacity of about 25-30 gallons. After breaking oil shale into pebble-size pieces, I poured the oil shale into the tumbler. These smaller pieces provide greater surface area for the microorganism blend to contact and increase the efficiency of the process. Next enough water is added to cover the oil shale, coal, or cellulose. Warm (not hot) water will speed up the process. Potable water, or virtually any water as long as it does not contain contaminants that will kill the microorganism mixture, will work.

Pour in the microorganism mixture. For this size batch, 3 quarts (96 ounces) of microorganism mixture should be sufficient. If there is less, liquefying the oil shale, coal, or cellulose material will take longer. More mixture may speed up the process, but since microorganism mixtures are expensive, the amount shown may be the optimum amount for commercial profitability.

Next scatter about three cups of yeast evenly over the surface of the mixture and add about ½ cup of sugar (see discussion above). Close the door or seal on the tumbler or mixer if it has one. Our small mixer had a bolt-on cover. There are variances in the type of seal and that will not affect the outcome. If using a large concrete mixer, close the door to seal the mixture if it has one, or leave as is if it does not.

Turn the tumbler or mixer on to rotate and agitate the entire mixture. The tumbler or mixer speed may affect the speed at which the microorganisms will liquefy the contents. Faster speeds up the process, slower will slow the process. I have not determined the upper limits on the speed of the tumbler or mixer. This formula has had success in liquefying oil shale in less than 12 hours.

12-ton example. As an example, if using 12 tons of oil shale ore, coal, or cellulose material, add enough water to completely cover the load. You would then calculate the ideal amount of microorganism mix, yeast and sugar as follows:

These measurements are sufficient to free the oil from the shale in about 24 hours. 12 tons equals 24,000 pounds of oil shale, coal or cellulose. 24,000 pounds is about 1,090 times 22 pounds. Three quarts of microorganism mixture equals 96 ounces. 96 ounces times 1,090 equals 104,640 ounces, or about 817 gallons of microorganism mixture would be needed. Three cups of yeast would equal 3,270 cups of yeast or about 204 gallons of yeast. ½ cup of sugar would equal about 17 gallons of sugar. Of course, one could use fewer microorganisms, yeast or sugar, and more water, but it takes longer for the quantity of microorganisms to grow into the quantity necessary to liquefy the oil shale, coal, or cellulose material. Obviously a commercial scale operation could not be done in a small home shop.

In an alternative embodiment, the amount of biomedium can be scaled for different needs. The amounts of water, nutrients, oil shale, and muriatic acid may increased or decreased so long as amounts of each ingredient are scaled equally. We have been able to store the biomedium at approximately room temperature for as long as about twenty one days.

In another embodiment, any microorganisms that excrete acid are selected for the biomedium. As the microorganisms consume the sugar, the mixture of biomedium and oil shale becomes progressively more acidic concurrent to the mechanical agitation of the mixture. The acid dissolves the sedimentary matrix of the oil shale. Mechanical agitation promotes physical breaking of the shale and ensures that the sedimentary matrix is constantly exposed to the biomedium and acid. The biomedium contains enough microorganisms, water, and nutrients to produce a sufficient quantity of bacteria and acid for the duration of processing.

In yet another embodiment, the biomedium is placed in a rotary tumbler with pea-size oil shale. The rotary tumbler mechanically agitates the mixture for approximately twelve hours to produce a liquid suspension. Rotary tumblers are very simple mechanical devices and are operated even by novice technicians. The duration of mechanical agitation varies at least with the particular type of oil shale, desired degree of enrichment, and size of load.

The final step to marketable product is to recover the oil from the liquid mixture oil shale, liquid coal, or cellulose material. The oil may be removed through the use of a weir dam, by the use of chemical separation agents, or any number of existing ore separation methods, including a centrifuge. The size of the centrifuge would vary depending on the volume of material to be separated, from a small laboratory size centrifuge to large industrial centrifuges.

When I centrifuged the mixture, I observed the lighter materials, such as the water and oil in the upper layer or layers, and the heavier elements and minerals separated at the bottom (various shades of brown). At the very bottom, almost black in appearance were the heavier metals, for example, gold and platinum group metals obtained from oil shale. The composition of the recovered products depends directly on the composition of the oil shale, coal, or cellular material.

There are several different manufacturers of large commercial centrifuges on the market. Some are vertical, and others are horizontal, such are used at mine sites in California or Nevada. Such centrifuges come in many sizes and models. They can process our sludge in quantities from 60 gallons per minute (gpm) to 1,000 gpm.

The advantages of using a centrifuge to separate the sludge is that while there is only one feed inlet, there can be multiple discharge outlets, and they can be used to decant (dewater) the sludge by removing the liquids by gravity with weir dams built into the centrifuge body. The solids are removed from the other end and can then be treated using additional and existing ore separation technologies. There is one technology in particular we are exploring, and it can be used to separate all solids down to very small particle sizes, which would be beneficial for the gold and platinum group metals.

In another embodiment, components of the liquid suspension are separated by use of a weir dam.

In another embodiment, components of the liquid suspension are separated by use of a centrifuge.

In another embodiment, components of the liquid suspension are separated by use of a filter.

In another embodiment, components of the liquid suspension are separated by use of chemical agents such as soap, salts, or any other chemical agent normally used by a person of ordinary skill in the art.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprise" and/or "comprising", when used in this specification, specify the presence of stated features, integers, steps, operations, elements, and/or components, but do not preclude the presence or addition of one of more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variation will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention has been described in an illustrative manner, it is to be understood that the terminology which has been used is intended to be in the nature of words of description rather than words of limitation. Many modifications and variations of the invention are possible in light of the above teachings. Therefore, within the scope of the appended claims, the invention may be practiced other than as specifically described.

I claim:

1. A method of producing one or more liquid hydrocarbon compounds, from a feedstock comprising oil shale, the method comprising:

a) providing a particular load of pebble sized feedstock comprising kerogen ensconced in a mineral matrix into an open ended tumbler that is rotatable about an axis;

b) providing a quantity of water sufficient to cover the load of pebble sized feedstock;

c) providing an acidic biomedium comprising mold found on moldy oranges that has been pre-trained to act on the particular load of feedstock provided and nutrients;

d) reducing the particular load of pebble sized feedstock to a liquid by the combined biotic action of the acidic biomedium on the pebble sized feedstock and progressively breaking the pebble sized feedstock by rotating the tumbler at ambient temperature and pressure; and e) separating the liquefied feedstock to recover the one or more liquid hydrocarbon compounds and aqueous minerals.

2. The method of claim 1, further comprising introducing an inert tumbling medium into the tumbler.

3. The method of claim 1, wherein the particular pebble sized feedstock also includes coal.

4. The method of claim 3, wherein the particular pebble sized feedstock also includes cellulose.

5. The method of claim 1, further comprising providing yeast into the tumbler.

6. The method of claim 5, further comprising providing sugar into the tumbler.

7. The method of claim 6, wherein the ratio of acidic biomedium, yeast and sugar by volume is approximately 79.5%, 19.5% and 1%, respectively.

* * * * *